US011834773B2

(12) United States Patent
Lee et al.

(10) Patent No.: US 11,834,773 B2
(45) Date of Patent: Dec. 5, 2023

(54) WASHING MACHINE

(71) Applicant: SAMSUNG ELECTRONICS CO., LTD., Suwon-si (KR)

(72) Inventors: Geon Ung Lee, Suwon-si (KR); Hwang Mook Cho, Suwon-si (KR); Jin Baek Kim, Suwon-si (KR); Hyun Joo Kim, Suwon-si (KR); Jun Hong Park, Suwon-si (KR); Eung Ryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 435 days.

(21) Appl. No.: 17/054,016

(22) PCT Filed: May 13, 2019

(86) PCT No.: PCT/KR2019/005719
§ 371 (c)(1),
(2) Date: Nov. 9, 2020

(87) PCT Pub. No.: WO2019/221462
PCT Pub. Date: Nov. 21, 2019

(65) Prior Publication Data

US 2021/0238791 A1 Aug. 5, 2021

(30) Foreign Application Priority Data

May 16, 2018 (KR) ..... 10-2018-0055960

(51) Int. Cl.
*D06F 39/08* (2006.01)
*D06F 39/02* (2006.01)
(Continued)

(52) U.S. Cl.
CPC ..... *D06F 39/08* (2013.01); *B01F 21/20* (2022.01); *B01F 25/10* (2022.01); *D06F 33/37* (2020.02);
(Continued)

(58) Field of Classification Search
None
See application file for complete search history.

(56) References Cited

U.S. PATENT DOCUMENTS

2005/0022319 A1* 2/2005 Kim ..... D06F 39/083 68/17 R
2015/0337480 A1* 11/2015 Lee ..... D06F 39/028 68/17 R

FOREIGN PATENT DOCUMENTS

DE 8703647 U1 10/1987
DE 3717477 A1 12/1988
(Continued)

OTHER PUBLICATIONS

International Search Report dated Aug. 23, 2019 from International Application No. PCT/KR2019/005719, 3 pages.
(Continued)

*Primary Examiner* — Cristi J Tate-Sims
(74) *Attorney, Agent, or Firm* — STAAS & HALSEY LLP

(57) ABSTRACT

Provided is a washing machine capable of improving solubility of a powder detergent that remains without having been dissolved in mixing water contained in a tub. The washing machine includes a cabinet having a detergent supplier, a tub arranged in the cabinet to be connected to the detergent supplier and containing mixing water in which washing water supplied to the detergent supplier and a powder detergent are mixed, a drum rotatably installed in the tub, a circulation hose connecting between the tub and the drum for the mixing water contained in a lower portion of
(Continued)

the tub to be circulated, a detergent dissolution device generating vortex current in mixing water circulated through the circulation hose to improve solubility of the powder detergent, and a circulation pump arranged in the circulation hose and configured to repeatedly supply and discharge mixing water to and from the detergent dissolution device through on/off controlling.

12 Claims, 11 Drawing Sheets

(51) Int. Cl.

| | |
|---|---|
| ***D06F 33/37*** | (2020.01) |
| ***B01F 21/20*** | (2022.01) |
| ***B01F 25/10*** | (2022.01) |
| *D06F 105/02* | (2020.01) |
| *B01F 101/00* | (2022.01) |

(52) U.S. Cl.
CPC ..... *D06F 39/02* (2013.01); *D06F 39/028* (2013.01); *D06F 39/083* (2013.01); *B01F 2101/4505* (2022.01); *D06F 2105/02* (2020.02)

(56) References Cited

FOREIGN PATENT DOCUMENTS

| | | |
|---|---|---|
| EP | 2420609 A2 | 2/2012 |
| KR | 10-2005-0014506 | 2/2005 |
| KR | 10-2005-0066356 | 6/2005 |
| KR | 10-2010-0094797 | 8/2010 |
| KR | 10-2013-0010801 | 1/2013 |
| KR | 10-1568209 | 11/2015 |

OTHER PUBLICATIONS

Extened European Search Report dated Dec. 15, 2020 from European Application No. 19804455.4, 7 pages.
European Office Action dated Oct. 6, 2022 in European Patent Application No. 19 804 455.4 (4 pages).
Korean Office Action dated Sep. 17, 2022 in Korean Patent Application No. 10-2018-0055960 (7 pages; 6 pages English translation).

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2019/005719 filed on May 13, 2019, which claims foreign priority benefit under 35 U.S.C. § 119 of Korean Patent Application 10-2018-0055960 filed on May 16, 2018, in the Korean Intellectual Property Office, the contents of both of which are incorporated herein by reference.

TECHNICAL FIELD

The disclosure relates to a washing machine capable of improving solubility of a powder detergent that remains without having been dissolved in mixing water contained in a tub.

BACKGROUND ART

A common front loading washing machine does the laundry with a drum horizontally arranged in a cabinet turning alternately clockwise and counterclockwise to lift clothes up along the inner circumferential surface of the drum with washing water and then letting the clothes fall.

A detergent supply device is arranged in the cabinet to supply a detergent to the tub, and the washing water supplied from outside passes through the detergent supply device and is thus mixed with the detergent.

Mixing water in which the washing water and the detergent are mixed is supplied to the tub through a supply tube, in which case when the detergent is powder detergent, some of the powder detergent remains without having been dissolved in the mixing water supplied to the tub.

The powder detergent that has not been dissolved in the mixing water sinks to the bottom of the tub, and even though the powder detergent deposited is dissolved to a certain extent by rotation of the drum, not all of them are dissolved.

To dissolve the powder detergent in the mixing water, the tub and the drum may be connected by a circulation path and the mixing water is to be pumped by a circulation pump, so that the powder detergent in the mixing water may be dissolved while the mixing water is circulated between the tub and the drum.

However, there is a limit to solubility of the powder detergent in the mixing water because the mixing water circulating between the tub and the drum through the circulation path is circulated only in one direction.

DISCLOSURE

Technical Problem

The disclosure provides a washing machine capable of improving solubility of a powder detergent that remains without having been dissolved in mixing water contained in a tub.

Technical Solution

According to an embodiment of the disclosure, a washing machine includes a cabinet having a detergent supplier, a tub arranged in the cabinet to be connected to the detergent supplier and containing mixing water in which washing water supplied to the detergent supplier and a powder detergent are mixed, a drum rotatably installed in the tub, a circulation hose connecting between the tub and the drum for the mixing water contained in a lower portion of the tub to be circulated, a detergent dissolution device generating vortex current in mixing water circulated through the circulation hose to improve solubility of the powder detergent, and a circulation pump arranged in the circulation hose and configured to repeatedly supply and discharge mixing water to and from the detergent dissolution device through on/off controlling.

The detergent dissolution device may be arranged at a higher location than the circulation pump.

When the circulation pump is controlled to be on, mixing water contained in a lower portion of the tub may be supplied to the detergent dissolution device through the circulation hose.

Mixing water supplied to the detergent dissolution device may stay in the detergent dissolution device for an increased time due to the vortex current generated in the detergent dissolution device, and mixing water with solubility of the powder detergent improved as much as the increased time may be supplied to the drum.

When the circulation pump is controlled to be off, mixing water supplied into the detergent dissolution device may be discharged by gravity toward the circulation pump from the detergent dissolution device.

Mixing water to be discharged from the detergent dissolution device may stay in the detergent dissolution device for an increased time due to the vortex current generated in the detergent dissolution device, and mixing water with solubility of the powder detergent improved as much as the increased time may be supplied to the tub. The circulation pump may control time to supply and discharge mixing water to and from the detergent dissolution device to prevent the mixing water from overflowing from the detergent dissolution device.

The circulation hose may include a first circulation hose connecting between the tub and the circulation pump, a second circulation hose connecting between the circulation pump and the detergent dissolution device, and a third circulation hose connecting between the detergent dissolution device and the drum.

The detergent dissolution device may include a vortex generating member generating vortex current, a flow part in which mixing water having the vortex current generated by the vortex generating member flows, a vortex generating member fixer arranged underneath the flow part to fix the vortex generating member, a first connector arranged underneath the vortex generating member fixer and coupled to the second circulation hose, and a second connector arranged in an upper portion of the flow part and coupled to the third circulation hose.

Mixing water may be supplied into the flow part or discharged out of the flow part by on/off controlling of the circulation pump.

The second connector may be arranged at a highest portion of the flow part.

The vortex generating member fixer may include a linkage part linking the first connector to the flow part, and a fixing projection to fix the current generating member.

The vortex generating member may include a cylindrical rim, an impeller-shaped vortex generator arranged within the rim and generating vortex current, and a fixing groove arranged outside of the rim and fixed by being put on the fixing projection.

The vortex generating member may include a cylindrical rim, a baffle-shaped vortex generator arranged to have a plurality of baffles extend inwards from the rim and generating vortex current, and a fixing groove arranged outside of the rim and fixed by being put on the fixing projection.

The detergent dissolution device may include a flow part in which mixing water flows, a vortex generating member integrally provided on an inner side of the flow part and having a spiral shape to generate vortex current, a first connector arranged underneath the flow part and coupled to the second circulation hose, and a second connector arranged in an upper portion of the flow part and coupled to the third circulation hose.

Advantageous Effects

According to embodiments of the disclosure, solubility of a powder detergent that remains in mixing water contained in a tub may be improved.

MODE OF THE DISCLOSURE

Figure 1:
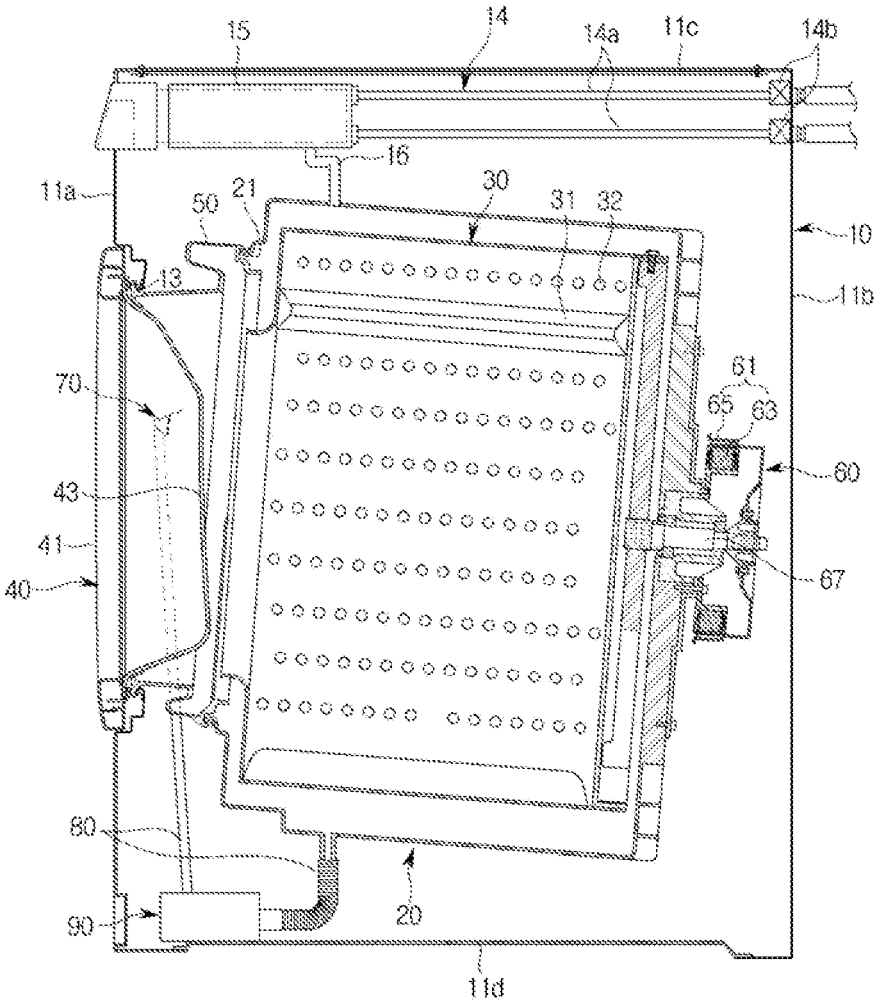
FIG. 1 is a side cross-sectional view of a schematic structure of a washing machine, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Embodiments of the present disclosure will now be described in detail with reference to accompanying drawings.

Figure 2:
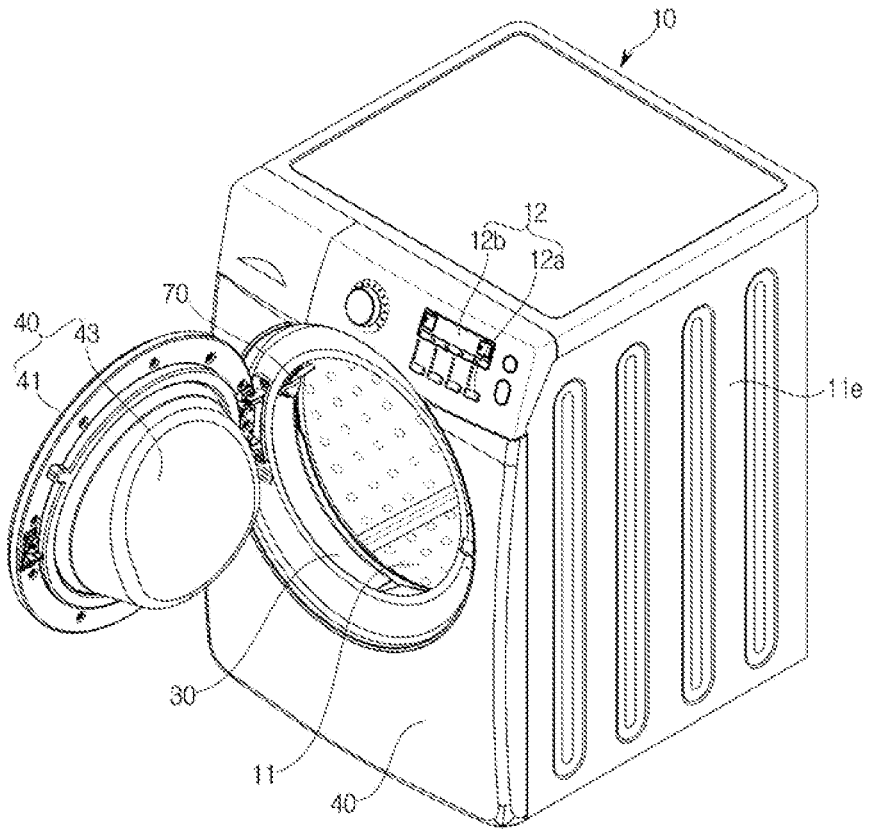
FIG. 2 is a perspective view of a washing machine with a door open, according to an embodiment of the disclosure.
Figure 3:
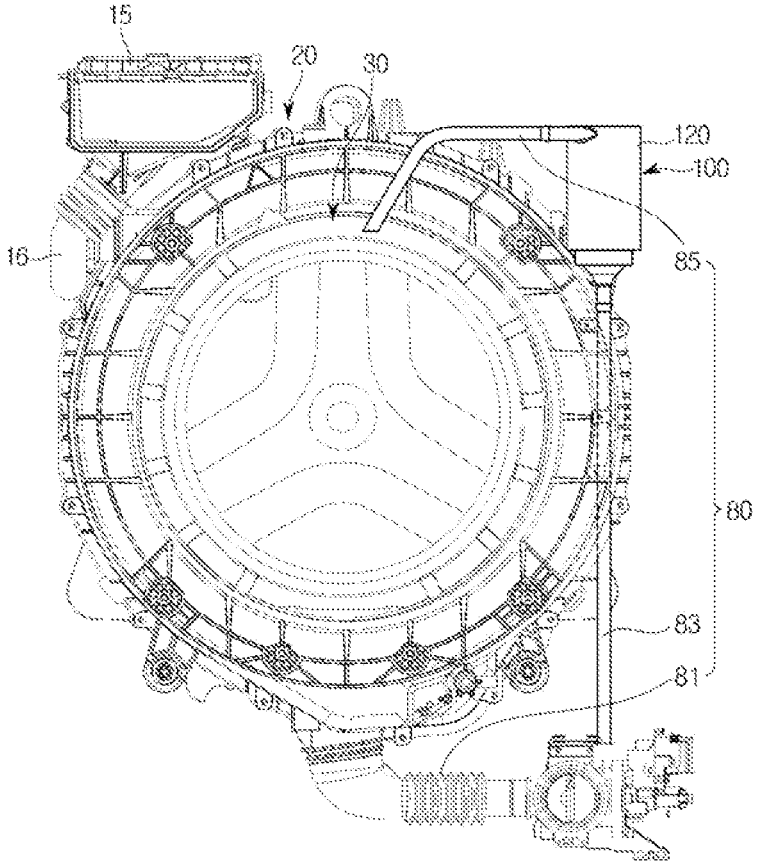
FIG. 3 is a front cross-sectional view of a schematic structure of a washing machine, according to an embodiment of the disclosure.

FIG. 1 is a side cross-sectional view of a schematic structure of a washing machine, according to an embodiment of the disclosure, FIG. 2 is a perspective view of a washing machine with a door open, according to an embodiment of the disclosure, and FIG. 3 is a front cross-sectional view of a schematic structure of a washing machine, according to an embodiment of the disclosure.

As shown in FIGS. 1 to 3, a washing machine includes a cabinet 10 defining an external appearance and containing many different components, a tub 20 arranged in the cabinet 10 to store mixing water in which washing water and a detergent are mixed, a drum 30 arranged in the tub 20 to contain and rotate laundry, and a driving device 60 for rotating the drum 30.

The cabinet 10 may have the form of almost a box, including a front plate 11*a*, a rear plate 11*b*, a top plate 11*c*, a bottom plate 11*d*, and side plates 11*e*.

A control panel 12 having an input module 12*a* for receiving an operation command from a user and a display module 12*b* for displaying operation information of the washing machine may be arranged on the front plate 11*a*.

An inlet 13 through which to put the laundry into the drum 30 may be formed on the front plate 11*a*.

The inlet 13 arranged on the front plate 11*a* may be opened or closed by a door 40.

The door 40 may be pivotally coupled to the front plate 11*a* of the cabinet 10 by a hinge member (not shown).

The door 40 may include a door frame 41 and a glass member 43.

The glass member 43 may be formed with a transparent tempered glass substance through which to see the inside of the cabinet 10.

The glass member 43 may be formed to protrude toward the inside of the tub 20 to prevent the laundry from being concentrated toward the door 40.

A water supplier 14 for supplying washing water into the tub 20 may be arranged in an upper portion of the cabinet 10.

The water supplier 14 may include a water supply tube 14*a* through which to supply the washing water from an external water supply source, and a water supply valve 14*b* for opening or closing the water supply tube 14*a*.

A detergent supplier 15 may be provided in a front upper portion of the cabinet 10 for supplying a detergent.

The detergent supplier 15 may be connected to the tub 20 through a supply tube 16.

Washing water supplied through the water supply tube 14*a* passes through the detergent supplier 15 to be mixed with the detergent, and mixing water in which the washing water and the detergent are mixed may be supplied into the tub 20.

A driving device 60 for generating rotational force to rotate the drum 30 may be arranged on the rear side of the tub 20.

The driving device 60 may include a driving motor 61 for generating the rotational force, and a driving shaft 67 for conveying the rotational force generated by the driving motor 61 to the drum 30.

The driving motor 61 may be configured with a stationary stator 63 and a rotor 65 rotated by electromagnetic interaction with the stator 63, to convert electric power to mechanical rotational force.

The driving shaft 67 may be press-fitted to the rotor 65 of the driving motor 71 to be rotated along with the rotor 65, and may connect between the drum 30 and the driving motor 61 by running through a rear wall of the tub 20.

The tub 20 may store mixing water in which washing water and a detergent are mixed, and have a substantially cylindrical shape.

The tub 20 may be fixed inside the cabinet 10.

Although in the embodiment of the disclosure the tub 20 is arranged for its center axis to be somewhat tilted from the horizontal plane, it may be arranged to be leveled.

An opening 21 may be formed on the front of the tub 20 to correspond to the inlet 13.

The inlet 13 of the front plate 11*a* and the opening 21 of the tub 20 may be coupled by a diaphragm 50.

The diaphragm 50 may define a path between the inlet 13 of the front plate 11*a* and the opening 21 of the tub 20 to guide the laundry put in through the inlet 13 into the drum 30 and diminish vibration that occurs when the drum 30 is rotated being traveled to the cabinet 10.

An injection nozzle 70 connected to a circulation hose 80, which will be described later, to inject the mixing water circulated through the circulation hose 80 into the drum 30 may be arranged substantially in an upper left portion of the diaphragm 50.

The injection nozzle 70 may inject the mixing water evenly across the whole laundry contained in the drum 30.

The drum 30 may have an almost cylindrical form with an open front, and may be arranged to be able to rotate within the tub 20.

The drum 30 may be arranged such that its center axis is parallel to the center axis of the tub 20.

The drum 30 may perform washing by lifting and dropping the laundry while being rotated in the tub 20.

For this, a plurality of lifters 31 may be arranged on the inner circumferential surface of the drum 30 to lift the laundry while the drum 30 is rotated.

A lot of through holes 33 may be formed around the drum 30 for mixing water contained in the tub 20 to flow through.

Mixing water is stored in a lower portion of the tub 20, in which case when the detergent supplied from the detergent supplier 15 is a powder detergent, some of the powder detergent that have not been dissolved may remain in the mixing water in which the washing water supplied from the water supplier 14 and the powder detergent are mixed.

The powder detergent that remains without having been dissolved may be dissolved to a certain extent by rotation of the drum 30, but not all the powder detergent may be dissolved and may sink to the bottom of the tub 20.

In order to improve solubility of the powder detergent that remains in the mixing water, the washing machine may include the circulation hose 80 to facilitate circulation of the mixing water between the tub 20 and the drum 30.

The circulation hose 80 may connect between the tub 20 and the drum 30 for the mixing water to be circulated between the tub 20 and the drum 30.

The injection nozzle 70 may be arranged where the circulation hose 80 and the drum 30 are connected, so that the mixing water supplied to the drum 30 from the tub 20 through the circulation hose 80 may be injected into the drum 30 through the injection nozzle 70.

The mixing water repeatedly makes circulating movements between the tub 20 and the drum 30 through the circulation hose 80, thereby improving solubility of the powder detergent that remains without having been dissolved in the mixing water.

A circulation pump 90 may be arranged in the circulation hose 80 for pumping the mixing water stored in the lower portion of the tub 20 in order for the mixing water to be circulated through the circulation hose 80.

Although not shown, the washing machine may include a drain hose (not shown) to drain the mixing water stored in the tub 20 out of the cabinet 10 during a draining process, and a drain pump (not shown) for pumping the mixing water to be drained through the drain hose.

Furthermore, a detergent dissolution device 100 may be arranged at the circulation hose 80 for causing vortex current to the mixing water circulating through the circulation hose 80 to improve solubility of the powder detergent.

The circulation hose 80 may include a first circulation hose 81 connecting the tub 20 to the circulation pump 90, a second circulation hose 83 connecting the circulation pump 90 to the detergent dissolution device 100, and a third circulation hose 85 connecting the detergent dissolution device 100 to the drum 30.

The circulation pump 90 may be arranged between the first circulation hose 81 and the second circulation hose 83 and may be connected to the tub 20 by the first circulation hose 81.

Through on/off controlling of the circulation pump 90, the mixing water circulating the circulation hose 80 may be supplied to the detergent dissolution device 100 or discharged out of the detergent dissolution device 100, which will be described later.

The detergent dissolution device 100 may be arranged between the second circulation hose 83 and the third circulation hose 85 for causing vortex current to the mixing water circulating through the circulation hose 80, thereby improving solubility of the powder detergent that remains without having been dissolved in the mixing water.

The detergent dissolution device 100 may be arranged in a higher position than the circulation pump 90 for the mixing water to be discharged from the detergent dissolution device 100 by gravity.

Figure 4:
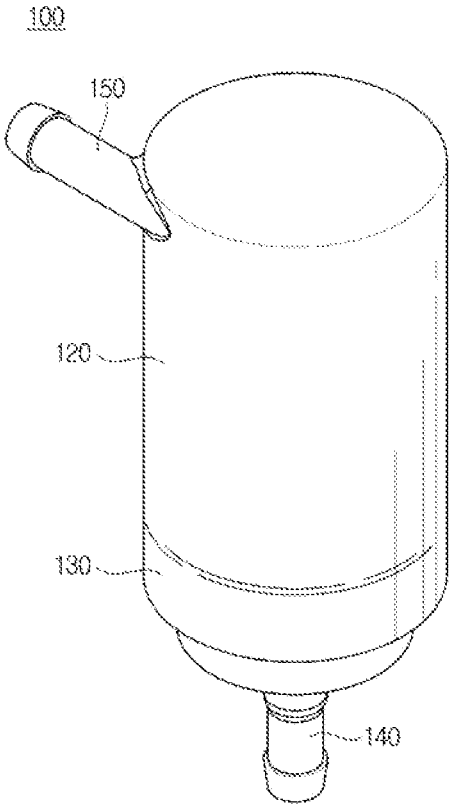
FIG. 4 is a perspective view of a detergent dissolution device, according to an embodiment of the disclosure.
Figure 5:
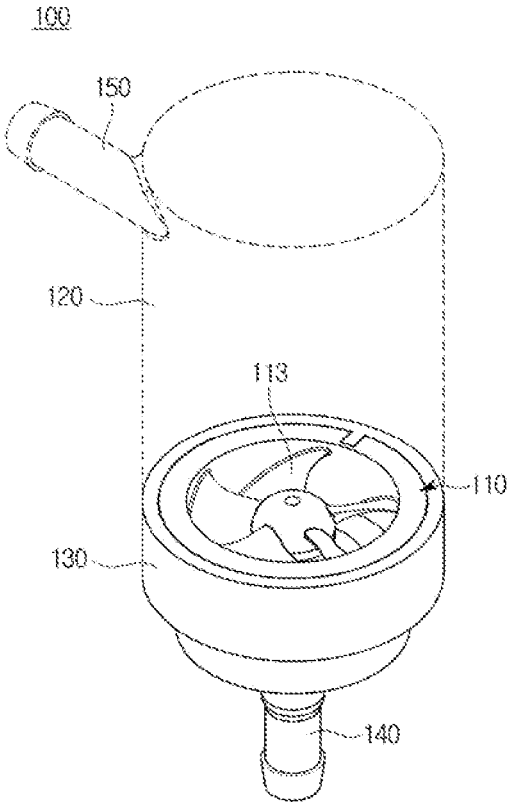
FIG. 5 is a perspective view of a detergent dissolution device having a vortex generating member fixed therein, according to an embodiment of the disclosure.
Figure 6:
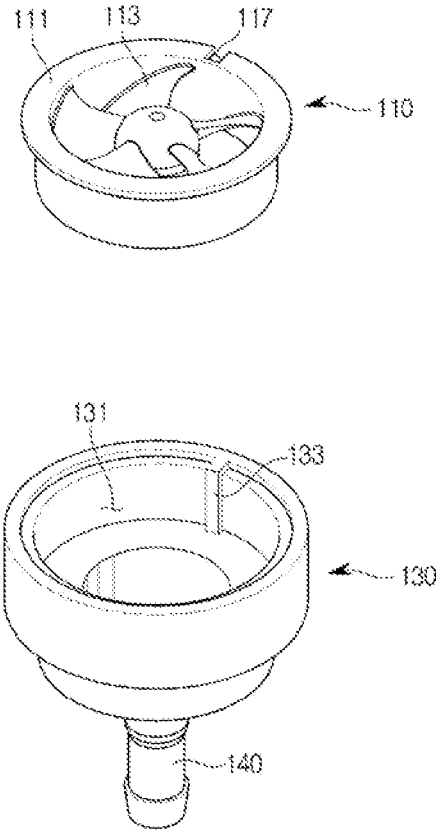
FIG. 6 shows a vortex generating member of a detergent dissolution device being fixed to a vortex generating member fixer, according to an embodiment of the disclosure.

FIG. 4 is a perspective view of a detergent dissolution device, according to an embodiment of the disclosure, FIG. 5 is a perspective view of a detergent dissolution device having a vortex generating member fixed therein, according to an embodiment of the disclosure, and FIG. 6 shows a vortex generating member of a detergent dissolution device being fixed to a vortex generating member fixer, according to an embodiment of the disclosure.

As shown in FIGS. 4 to 6, the detergent dissolution device 100 may include a vortex generating member 110 for generating vortex current, a flow part 120 in which mixing water having vortex current generated by the vortex generating member 110 flows, a vortex generating member fixer 130 arranged underneath the flow part 120 to fix the vortex generating member 110, a first connector 140 arranged underneath the vortex generating member fixer 130 and coupled to the second circulation hose 83, and a second connector 150 arranged in an upper portion of the flow part 120 and coupled to the third circulation hose 85.

The vortex generating member 110 may generate vortex current in the mixing water supplied into the detergent dissolution device 100 through the second circulation hose 83, to increase time for which the mixing water stays in the detergent dissolution device 100.

When the time for which the mixing water stays in the detergent dissolution device 100 increases, a flowing time of the mixing water increases as much as the increased time, which may improve solubility of the powder detergent that remains without having been dissolved in the mixing water.

The vortex generating member 110 may include a cylindrical rim 111, an impeller-shaped vortex generator 113 arranged within the rim 111 to generate vortex current, and a fixing groove 117 arranged on the outside of the rim 111 and fixed to the vortex generating member fixer 130.

The mixing water passing the impeller-shaped vortex generator 113 may form vortex current as the impeller-shaped vortex generator 113 that impedes flowing of the mixing water increases pressure and changes direction of the mixing water.

The fixing groove 117 may be put on a fixing projection 133 of the vortex generating member fixer 130, which will be described later, enabling the vortex generating member 110 to be fixed to the vortex generating member fixer 130.

Although the vortex generating member 110 is shown as being fixed to the vortex generating member fixer 130 not to be rotated, it is not limited thereto, and the vortex generating member 110 may be rotatably fixed to the vortex generating member fixer 130 to enable the impeller-shaped vortex generator 113 to be rotated.

The flow part 120 may be arranged over the vortex generating member 110 to have the shape of a hollow cylinder, providing space in which the mixing water having passed the vortex generating member 110 and thus having vortex current formed therein flows.

The vortex generating member fixer 130 may be arranged underneath the flow part 120.

The vortex generating member fixer 130 may include a linkage part 131 to link the first connector 140 to the flow part 120, and the fixing projection 133 to be put in and fixed to the fixing groove 117 of the vortex generating member 110.

The mixing water pumped by the circulation pump 90 and flowing into the first connector 140 through the second circulation hose 83 may form vortex current by the vortex generating member 110 fixed inside the linkage part 131 while passing the linkage part 131 and flow to the flow part 120. The mixing water having flowed into the flow part 120 may flow into the third circulation hose 85 through the second connector 150 and may be injected into the drum 30 through the injection nozzle 70 (see FIGS. 1 and 3).

It is desired that the second connector 150 be arranged in the highest portion of the flow part 120.

Figure 7:
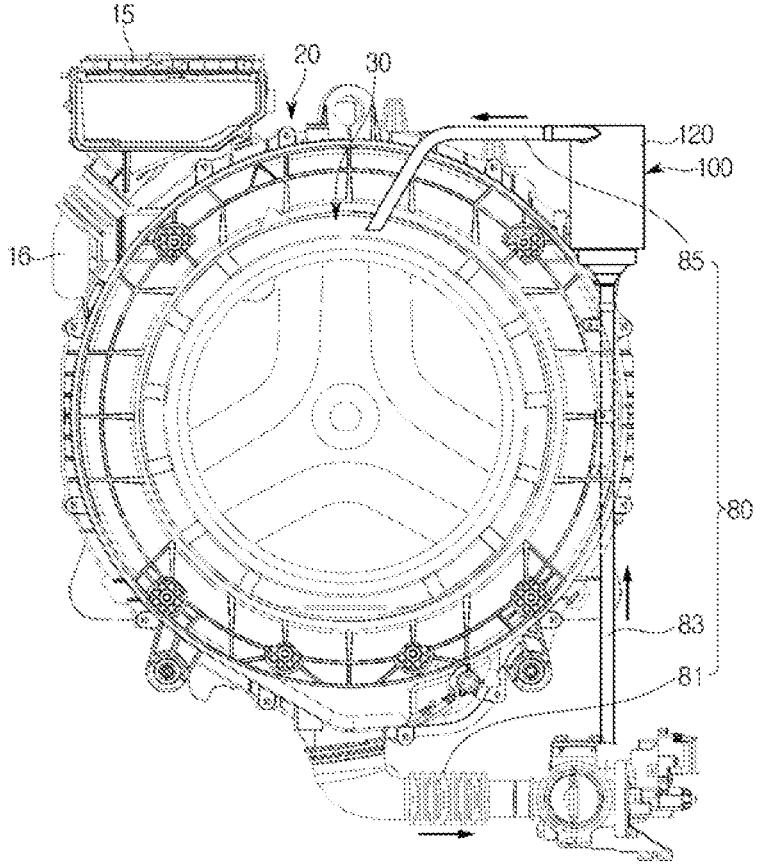
FIG. 7 shows a direction in which mixing water is circulated when a circulation pump is on, according to an embodiment of the disclosure.
Figure 8:
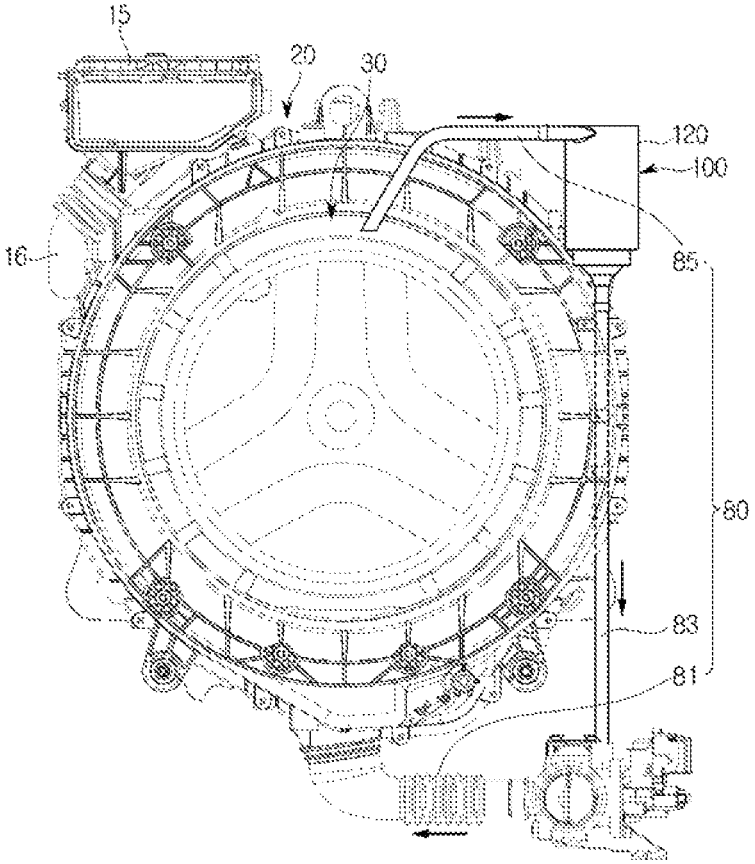
FIG. 8 shows a direction in which mixing water is circulated when a circulation pump is off, according to an embodiment of the disclosure.

FIG. 7 shows a direction in which mixing water is circulated when a circulation pump is on, according to an embodiment of the disclosure, and FIG. 8 shows a direction in which mixing water is circulated when a circulation pump is off, according to an embodiment of the disclosure.

As shown in FIG. 7, when the circulation pump 90 is controlled to be on, the mixing water stored in the lower portion of the tub 20 may be supplied to the detergent dissolution device 100 through the first circulation hose 81 and the second circulation hose 83.

The mixing water supplied to the detergent dissolution device 100 may have vortex current formed therein and may be supplied into the drum 30 through the third circulation hose 85.

The mixing water supplied to the detergent dissolution device 100 and having vortex current formed therein may stay in the flow part 120 for a longer time, and mixing water with improved solubility of powder detergent as much as the increased time may be supplied into the drum 30.

As shown in FIG. 8, when the circulation pump 90 is controlled to be off, mixing water supplied into the detergent dissolution device 100 may be discharged by gravity in a direction toward the circulation pump 90 from the detergent dissolution device 100 through the second circulation hose 83.

The mixing water to be discharged from the detergent dissolution device 100 stays in the detergent dissolution device 100 for a longer time due to the vortex current generated in the detergent dissolution device 100, and mixing water with improved solubility of powder detergent as much as the increased time may be supplied to the tub 20 through the second circulation hose 83 and the first circulation hose 81.

Mixing water that has not flowed to the circulation hose 80 but stayed in a lower portion of the tub 20 while the circulation pump 90 is controlled to be on may be mixed with mixing water flowing into to the tub 20 from the drum 30 and may flow together when the circulation pump 90 is off, so that the solubility of the powder detergent may be improved.

As the mixing water is circulated from the tub 20 to the drum 30 or from the drum 30 to the tub 20 by on/off controlling of the circulation pump 90, flowing direction of the mixing water is changed, causing agitation of flowing, so that solubility of the powder detergent may be further improved.

The circulation pump 90 may control time to supply mixing water to the detergent dissolution device 100 and time to discharge the mixing water from the detergent dissolution device 100 to prevent the mixing water from overflowing from the flow part 120 through on/off controlling.

During a rinse course of the washing machine, the circulation hose 80 may be used as a circulation flow path by consistently keeping the circulation pump 90 on without on/off controlling.

Figure 9:
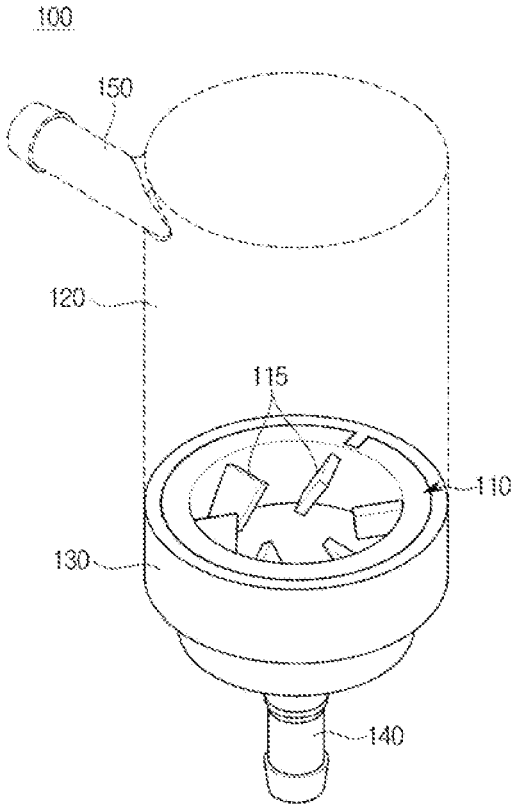
FIG. 9 is a perspective view of a detergent dissolution device having a vortex generating member fixed therein, according to another embodiment of the disclosure.
Figure 10:
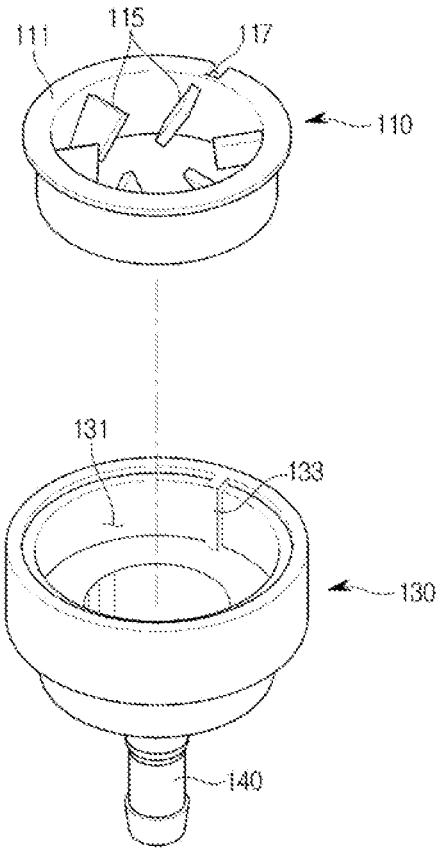
FIG. 10 shows a vortex generating member of a detergent dissolution device being fixed to a vortex generating member fixer, according to another embodiment of the disclosure.

FIG. 9 is a perspective view of a detergent dissolution device having a vortex generating member fixed therein, according to another embodiment of the disclosure, and FIG. 10 shows a vortex generating member of a detergent dissolution device being fixed to a vortex generating member fixer, according to another embodiment of the disclosure.

As shown in FIGS. 9 to 10, the detergent dissolution device 100 may include the vortex generating member 110 for generating vortex current, the flow part 120 in which mixing water having vortex current generated by the vortex generating member 110 flows, the vortex generating member fixer 130 arranged underneath the flow part 120 to fix the vortex generating member 110, the first connector 140 arranged underneath the vortex generating member fixer 130 and coupled to the second circulation hose 83, and the second connector 150 arranged in an upper portion of the flow part 120 and coupled to the third circulation hose 85.

It is all the same as the detergent dissolution device 100 as shown in FIGS. 4 to 6 except a vortex generator 115, so the description of the other components than the vortex generating member 110 will not be repeated.

The vortex generating member 110 may include the cylindrical rim 111, the vortex generator 115 having a baffle shape and arranged within the rim 111 to generate vortex current, and the fixing groove 117 arranged on the outside of the rim 111 and fixed to the vortex generating member fixer 130.

Mixing water passing the baffle-shaped vortex generator 115 may form vortex current as the baffle-shaped vortex generator 113 that impedes flowing of the mixing water increases pressure and changes direction of the mixing water.

The fixing groove 117 may be put on a fixing projection 133 of the vortex generating member fixer 130, enabling the vortex generating member 110 to be fixed to the vortex generating member fixer 130.

Figure 11:
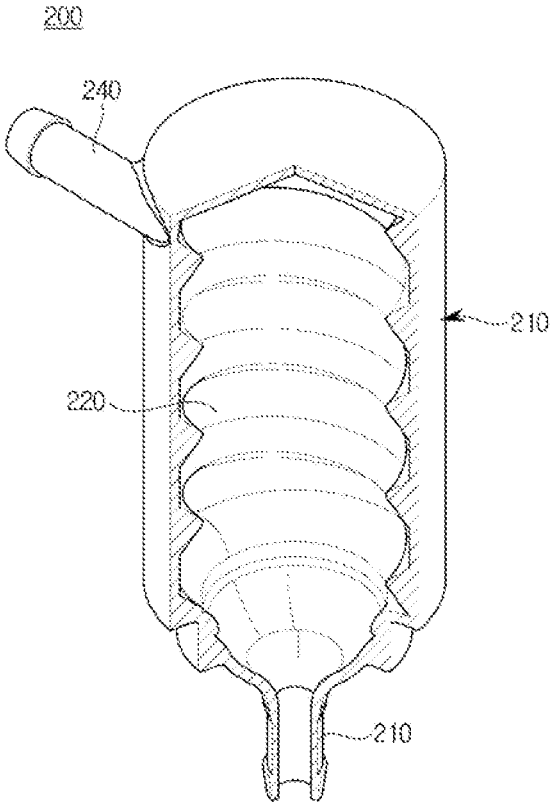
FIG. 11 shows a detergent dissolution device, according to another embodiment of the present disclosure.

FIG. 11 shows a detergent dissolution device, according to another embodiment of the present disclosure.

As shown in FIG. 11, the detergent dissolution device 200 may include a flow part 210 in which mixing water flows, a vortex generating member 220 provided integrally with the flow part 210 on the inner side of the flow part 210 and having a spiral form to generate vortex current, a first connector 230 arranged underneath the flow part 210 and coupled to the second circulation hose 83, and a second connector 240 arranged in an upper portion of the flow part 210 and coupled to the third circulation hose 85 (see FIG. 3).

Mixing water pumped by the circulation pump 90 and flowing into the first connector 230 through the second circulation hose 83 may form vortex current by the vortex generating member 220 integrally formed inside the flow part 210 while passing the flow part 210. The mixing water flowing in the flow part 210 with the vortex current formed therein may flow into the third circulation hose 85 through the second connector 240 and may be injected into the drum 30 through the injection nozzle 70 (see FIGS. 1 and 3).

It is desired that the second connector 240 be arranged in the highest portion of the flow part 210.

Particular shapes and directions are focused above in describing the washing machine with reference to the accompanying drawings, but a person of ordinary skill in the art will understand and appreciate that various modifications can be made without departing the scope of the disclosure. Thus, it will be apparent to those ordinary skilled in the art that the disclosure is not limited to the embodiments described, which have been provided only for illustrative purposes.

The invention claimed is:

1. A washing machine comprising:

a cabinet having a detergent supplier;

a tub arranged in the cabinet to be connected to the detergent supplier and containing mixing water in which washing water supplied to the detergent supplier and a powder detergent are mixed;

a drum rotatably installed in the tub;

a circulation hose connecting between the tub and the drum for the mixing water contained in a lower portion of the tub to be circulated;

a detergent dissolution device generating vortex current in mixing water circulated through the circulation hose to improve solubility of the powder detergent; and a circulation pump arranged in the circulation hose and configured to repeatedly supply and discharge mixing water to and from the detergent dissolution device through on/off controlling, wherein the circulation hose comprises a first circulation hose connecting between the tub and the circulation pump, a second circulation hose connecting between the circulation pump and the detergent dissolution device, and a third circulation hose connecting between the detergent dissolution device and the drum, and wherein the detergent dissolution device comprises a vortex generating member generating vortex current, a flow part in which mixing water having the vortex current generated by the vortex generating member flows, a vortex generating member fixer arranged underneath the flow part to fix the vortex generating member, a first connector arranged underneath the vortex generating member fixer and coupled to the second circulation hose, and a second connector arranged in an upper portion of the flow part and coupled to the third circulation hose.

2. The washing machine of claim 1, wherein the detergent dissolution device is arranged at a higher location than the circulation pump.

3. The washing machine of claim 2, wherein when the circulation pump is controlled to be on, mixing water contained in a lower portion of the tub is supplied to the detergent dissolution device through the circulation hose.

4. The washing machine of claim 3, wherein mixing water supplied to the detergent dissolution device stays in the detergent dissolution device for an increased time due to the vortex current generated in the detergent dissolution device, and mixing water with solubility of the powder detergent improved as much as the increased time is supplied to the drum.

5. The washing machine of claim 4, wherein when the circulation pump is controlled to be off, mixing water supplied into the detergent dissolution device is discharged by gravity toward the circulation pump from the detergent dissolution device.

6. The washing machine of claim 5, wherein mixing water to be discharged from the detergent dissolution device stays in the detergent dissolution device for an increased time due to the vortex current generated in the detergent dissolution device, and mixing water with solubility of the powder detergent improved as much as the increased time is supplied to the tub.

7. The washing machine of claim 6, wherein the circulation pump is configured to control time to supply and discharge mixing water to and from the detergent dissolution device to prevent the mixing water from overflowing from the detergent dissolution device.

8. The washing machine of claim 1, wherein mixing water is supplied into the flow part or discharged out of the flow part by on/off controlling of the circulation pump.

9. The washing machine of claim 8, wherein the second connector is arranged at a highest portion of the flow part.

10. The washing machine of claim 9, wherein the vortex generating member fixer comprises a linkage part linking the first connector to the flow part, and a fixing projection to fix the current generating member.

11. The washing machine of claim 10, wherein the vortex generating member comprises a cylindrical rim, an impeller-shaped vortex generator arranged within the rim and generating vortex current, and a fixing groove arranged outside of the rim and fixed by being put on the fixing projection.

12. The washing machine of claim 10, wherein the vortex generating member comprises a cylindrical rim, a baffle-shaped vortex generator arranged to have a plurality of baffles extend inwards from the rim and generating vortex current, and a fixing groove arranged outside of the rim and fixed by being put on the fixing projection.

* * * * *